US007204581B2

(12) United States Patent
Peeters

(10) Patent No.: US 7,204,581 B2
(45) Date of Patent: Apr. 17, 2007

(54) MAGNETIC ACTUATOR USING FERROFLUID SLUG

(75) Inventor: Eric Peeters, Fremont, CA (US)

(73) Assignee: Palo Alto Research Center, Incorporated, Palo Alto, CA (US)

( * ) Notice: Subject to any disclaimer, the term of this patent is extended or adjusted under 35 U.S.C. 154(b) by 325 days.

(21) Appl. No.: 10/958,428

(22) Filed: Oct. 6, 2004

(65) Prior Publication Data

US 2006/0071973 A1 Apr. 6, 2006

(51) Int. Cl.

| | |
|---|---|
| ***B41J 2/04*** | (2006.01) |
| ***B41J 2/035*** | (2006.01) |
| ***F15C 1/04*** | (2006.01) |
| ***B65D 47/18*** | (2006.01) |
| *B01L 3/02* | (2006.01) |

(52) U.S. Cl. ..... 347/53; 137/827; 137/831; 137/909; 222/420; 422/100

(58) Field of Classification Search ..... 417/92, 417/98; 137/827, 909; 347/53
See application file for complete search history.

(56) References Cited

U.S. PATENT DOCUMENTS

| | | | | |
|---|---|---|---|---|
| 3,448,751 | A * | 6/1969 | Rosaen | 137/807 |
| 3,496,955 | A * | 2/1970 | Denison et al. | 137/13 |
| 3,508,564 | A * | 4/1970 | Nelson | 137/807 |
| 3,916,419 | A * | 10/1975 | Fan et al. | 347/55 |
| 4,057,807 | A * | 11/1977 | Fischbeck et al. | 347/40 |
| 4,078,238 | A * | 3/1978 | Lee | 347/53 |
| 4,130,394 | A * | 12/1978 | Negersmith | 436/179 |
| 4,258,315 | A * | 3/1981 | Westra | 324/654 |
| 4,315,267 | A * | 2/1982 | Sonoda et al. | 346/74.2 |
| 4,717,926 | A * | 1/1988 | Hotomi | 347/55 |
| 4,780,728 | A * | 10/1988 | Fost | 347/54 |
| 4,928,125 | A * | 5/1990 | Iino | 347/54 |
| 4,967,831 | A * | 11/1990 | Leland | 165/104.25 |
| 5,005,639 | A * | 4/1991 | Leland | 165/104.25 |
| 5,333,646 | A * | 8/1994 | Delot | 137/827 |
| 5,353,839 | A * | 10/1994 | Kordonsky et al. | 137/806 |
| 6,408,884 | B1 * | 6/2002 | Kamholz et al. | 137/827 |
| 6,415,821 | B2 * | 7/2002 | Kamholz et al. | 137/827 |

(Continued)

OTHER PUBLICATIONS

Menz et al., "Fluidic Components Based on Ferrofluids", 1st Annual International IEEE-EMBS Special Topic Conference on Microtechnologies in Medicine and Biology, Oct. 12-14, 2000, Lyon France, pp. 302-306.*

(Continued)

*Primary Examiner*—Burton Mullins
(74) *Attorney, Agent, or Firm*—Oliff & Berridge, PLC

(57) ABSTRACT

A magnetostatic actuator uses a ferrofluid slug confined in a cylindrical tube which is wrapped in a conducting coil. By applying a current to the coil, a magnetic field is generated inside the coil. The ferrofluid slug may be attracted to the interior of the coil by the interaction of its magnetic moment with the field generated inside the coil. Movement of the ferrofluid slug in response to the magnetic field may be used to actuate various devices, such as a droplet dispenser.

20 Claims, 11 Drawing Sheets

U.S. PATENT DOCUMENTS 6,450,203 B1 * 9/2002 Backhouse et al. ..... 137/807
6,713,021 B1 * 3/2004 Shvets et al. ..... 422/100
6,739,576 B2 * 5/2004 O'Connor et al. ..... 251/129.14
6,743,399 B1 * 6/2004 Weigl et al. ..... 422/102
6,768,230 B2 * 7/2004 Cheung et al. ..... 310/30
6,858,184 B2 * 2/2005 Pelrine et al. ..... 422/68.1
2005/0001703 A1 * 1/2005 Zimmerling ..... 335/220

OTHER PUBLICATIONS

Greivell, N.E and Hannaford, B. (1997), "The Design of a Ferrofluid Magnetic Pipette," IEEE Trans. Biomed. Eng. 44(3): pp. 129-135.*

* cited by examiner

MAGNETIC ACTUATOR USING FERROFLUID SLUG

BACKGROUND OF THE INVENTION

1. Field of Invention

This invention is directed to magnetic actuators.

2. Description of Related Art

Actuators are, in general, magnetostatic, electrostatic, or mechanical. Magnetostatic actuators include well known solenoids, in which a coil of wire is energized to create a magnetic field in the interior of the coil which then interacts with a magnetic solid core, to attract the magnetic core into, or repel the magnetic core from, the interior of the coil.

FIG. 1 illustrates an example of a known solenoid actuator 1. A coil of wire 10 is energized by a current I, which produces a magnetic field B within the interior of coil 10. Magnetic core 20 interacts with magnetic field B created within coil 10 such that magnetic core 20 is pulled toward the interior of the coil. As core 20 is drawn into the interior of coil 10, the displacement may be used to actuate other devices such as valves or switches, which may be coupled to magnetic core 20. The solenoid actuator 1, in general, is only applied to devices requiring solid, mechanical actuation.

To actuate fluidic or hydraulic devices, such as droplet dispensers, fluid is forced under pressure through a cylindrical tube and out of an orifice. In the case of relatively large droplet dispensers, droplet formation generally occurs when the force of gravity exceeds the surface tension of the droplet at the orifice. Therefore, for droplet volumes of several hundred nanoliters to 1 microliter or more, droplets can be dispensed by syringe pipettes, for example.

For smaller droplet volumes, kinetic energy must be delivered to the droplet volume sufficient to overcome the surface tension at the point of ejection. Kinetic energy may be imparted by piezoelectric elements or thermal elements, such as those used in ink-jet devices. Typical ink-jet devices are capable of dispensing droplets in the 10 to 100 picoliter range.

However, for droplet sizes in the intermediate range, such as in the range 1 nanoliter to 1 microliter, limited options exist. If it is acceptable to contact the surface which will receive the droplet, then "quill-pen" contact dispensing is possible, wherein a slotted cylindrical tube draws fluid in by capillary force, and dispenses the fluid by contacting the slotted cylindrical tube to a receiving surface. When non-contact dispensers are required, systems are available which pressurize a fluid in a supply volume and provide miniature solenoid switches that switch the fluid pathway between the supply volume and the ejection orifice.

SUMMARY OF THE INVENTION

Such devices for non-contact dispensing of droplet sizes in the intermediate range tend to be expensive, difficult to clean, and not disposable. When working with sticky fluids such as biological samples and proteins, the devices may become clogged, requiring extensive cleaning and vacuum drying in order to begin operating reliably and reproducibly again. Often, dispensers used with biological samples require thorough and vigorous cleaning of the equipment in order to avoid inadvertent contamination of the samples.

Therefore, there is a need for improved actuation devices which are compatible with fluidic systems. Further, there is a need for a compact and inexpensive instrument for dispensing fluids in intermediate sized droplets. There is also a need for a disposable device, or one that is readily cleaned, and suitable for dispensing biological samples.

Accordingly, various implementations provide an actuator device that is compatible with fluidic systems. Further, various implementations provide systems and methods which are capable of dispensing intermediate sized droplets, particularly, intermediate sized droplets of biological fluids. Also, various implementations provide a droplet dispensing device that is inexpensive and disposable and/or easily cleaned.

A magnetostatic actuator can be used to displace a volume of fluid. For example, a droplet dispenser system may dispense intermediate sized droplets. Such a system may be relatively inexpensive to implement, and also may be disposable.

A magnetostatic actuator may include a slug of a ferrofluid contained in a tube. A coil of conductive wire may be wound around the tube, which, when energized by a current, may generate a magnetic field along an axis defined by the coil. The ferrofluid slug may be drawn into the interior of the coil by magnetostatic interaction of the magnetic field with the induced magnetic moment of the ferrofluid.

A set of current pulses may be delivered to a plurality of electrical coils surrounding the tube. By using a particular profile of current pulses, the ferrofluid slug may be driven in a particular trajectory within the tube, to provide, for example, a "whiplash" profile which can dispense more precise droplet sizes than otherwise would be possible. The plurality of current pulses may also be applied to the plurality of coils to increase the throw of the actuator.

Various implementations may provide a convenient means for measuring the displacement of the ferrofluid slug, for example, by measuring a change in the inductance of the coil as the ferrofluid enters into, or departs from, the interior of the coil.

These and other features and advantages of this invention are described in, or are apparent from, the following detailed description.

BRIEF DESCRIPTION OF THE DRAWINGS

Various exemplary implementations are described in detail, with reference to the following figures, wherein.

DETAILED DESCRIPTION

Systems and methods are disclosed which provide a ferrofluid magnetostatic actuator including a coil of conductive wire wrapped around a tube containing a ferrofluid slug. In various implementations, the tube is cylindrical and the coil is energized by a current which generates a magnetic field along the axis of the coil. The ferrofluid slug interacts with the magnetic field, and the interaction draws the ferrofluid slug toward the interior of the coil. The displacement of the ferrofluid slug may be used to actuate any of a number of other devices, such as switches or valves.

The word "slug" as used herein is used according to the Merriam-Webster Online Dictionary definition (http://www.m-w.com/cgi-bin/dictionary?book=Dictionary&va=slug) of "a detached mass of fluid (as water vapor or oil) that causes impact (as in a circulating system)."

Figure 1:
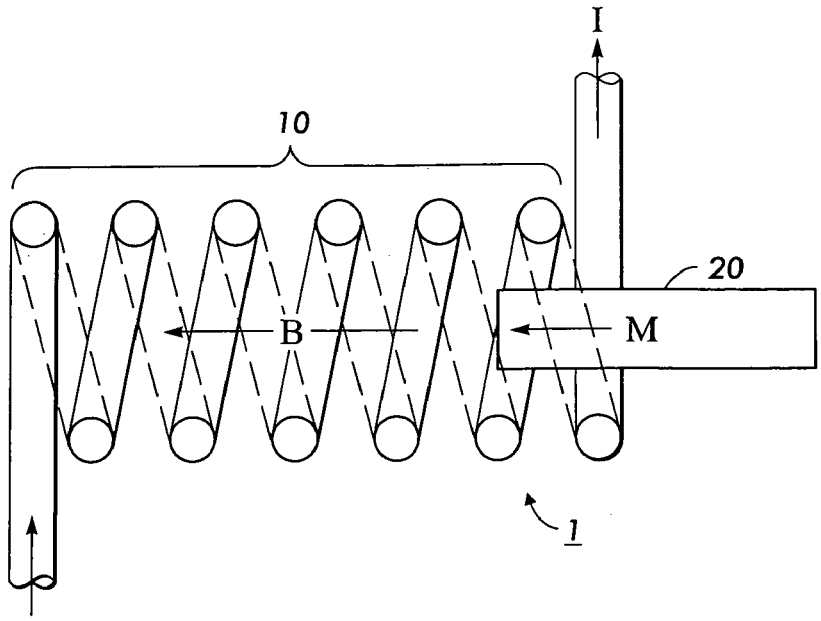
FIG. 1 PRIOR ART
FIG. 1 is a schematic diagram of a known magnetostatic actuator.
Figure 2:
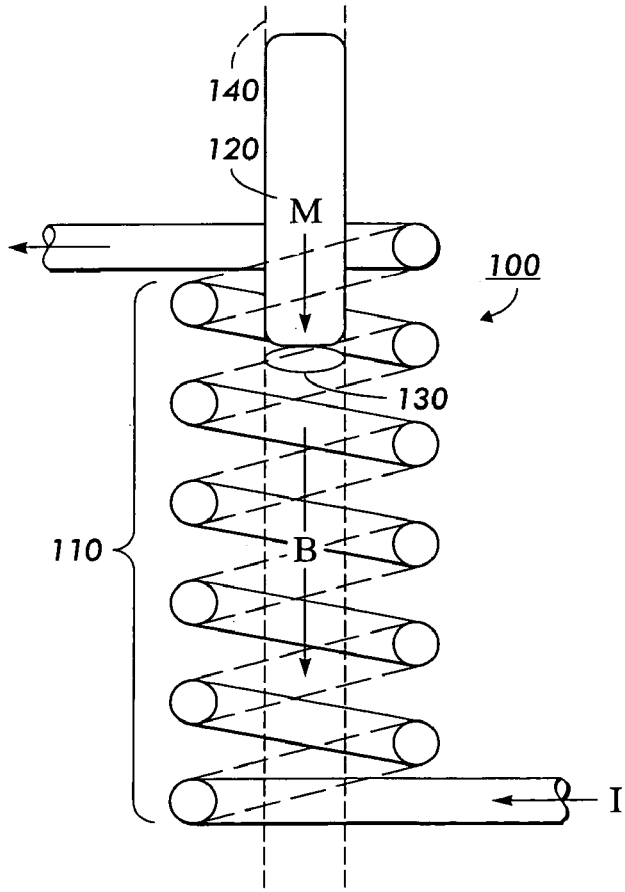
FIG. 2 illustrates an exemplary ferrofluid magnetostatic actuator using a ferrofluid slug.

FIG. 2 shows an exemplary ferrofluid magnetostatic actuator 100. The ferrofluid magnetostatic actuator includes a coil 110 which is wrapped around a cylindrical tube 140. The cylindrical tube contains a ferrofluid slug 120, and a movable piston 130. Piston 130 may be attached to an electrical switch or valve (not shown), in order to actuate the switch or valve. By applying a current I to coil 110, a magnetic field B is generated along an axis defined by coil 110, as shown in FIG. 1. Because the ferrofluid is a magnetizable material, it acquires a magnetization M upon exposure to the magnetic field B. The interaction of magnetization M with magnetic field B causes ferrofluid slug 120 to be drawn into the interior of coil 110 as illustrated in FIGS. 2 and 3.

Figure 3:
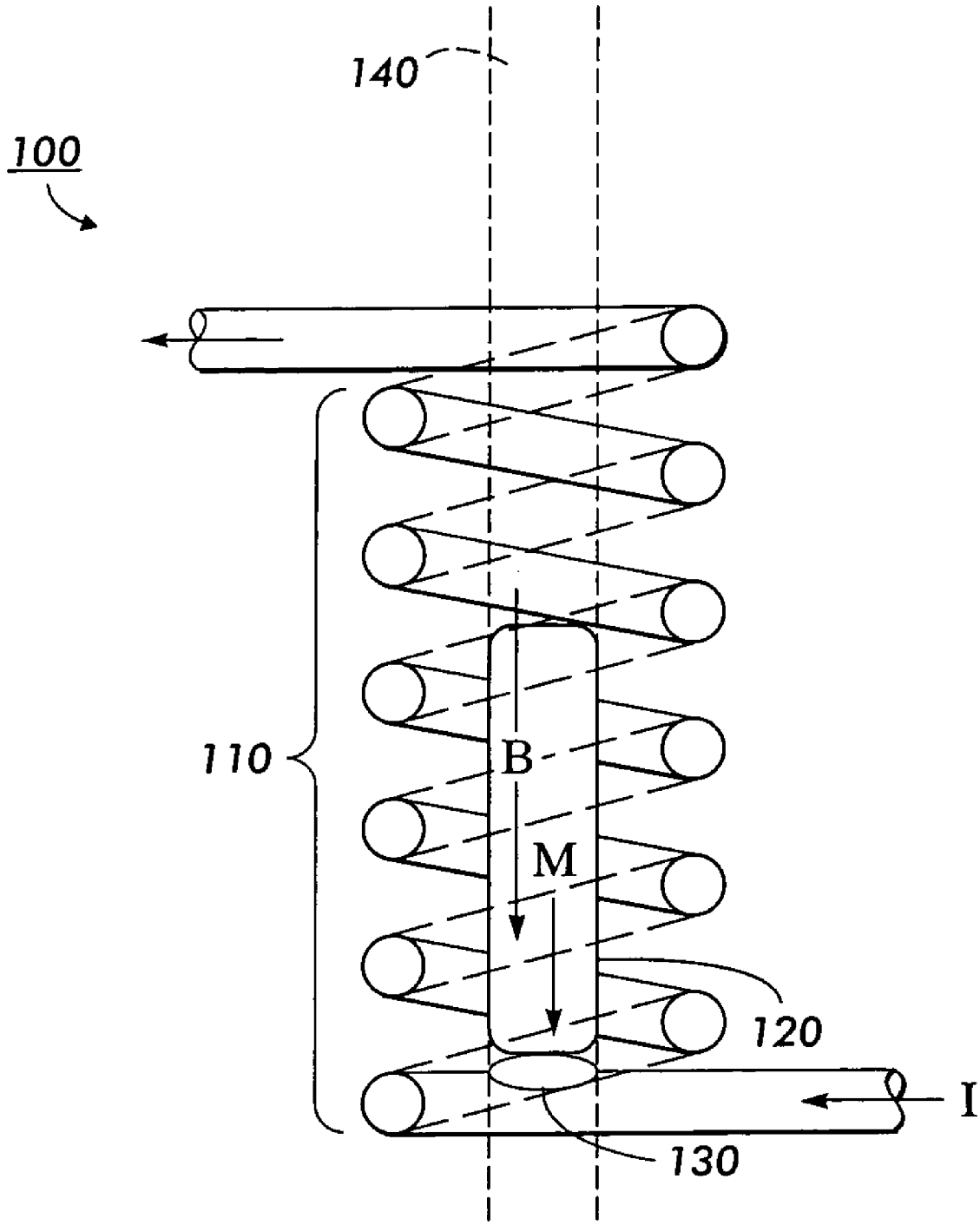
FIG. 3 illustrates the ferrofluid magnetostatic actuator of FIG. 2, with the slug in the extended position.

As ferrofluid slug 120 is drawn into the coil 110, ferrofluid slug 120 pushes against piston 130, and moves piston 130 to a different position, as shown in FIG. 3. Since the piston 130 is connected to a switch or valve, the displacement of the ferrofluid slug 120 causes the switch or valve to be activated.

Cylindrical tube 140 may be chosen to have a large enough diameter such that frictional effects of ferrofluid slug 120 moving along the walls of cylindrical tube 140 do not substantially slow the actuation speed of the device. However, if cylindrical tube 140 is made excessively large, then the response of the actuator will also be slowed because of inertial effects of the larger ferrofluid slug 120. A satisfactory cylindrical tube diameter may be, for example, about 0.5 mm.

For ease of depiction, coil 110 is illustrated in FIG. 3 as having only a few windings. Coil 110 wrapped around cylindrical tube 140, however, may be about 3 mm long and may include hundreds of windings to generate an acceptable magnetic field. The larger the number of windings, the stronger the magnetic field produced; however, the larger the number of windings, the larger the voltage source needed to drive the current. The coil 110 may be of any suitably conducting material, such as copper wire. The current I applied to the windings may be, for example, tens of milliAmperes (mA).

The magnetic field produced by a current I flowing through a wire can be calculated from Ampere's Law, $$\circ\int B^{*}dl=\mu_0 I \tag{1}$$

where $\mu_0$ is the permeability constant equal to $4\pi\times10^{-3}$ Gauss m/ampere, and the integral is taken around a closed path. In the case of a solenoid, Ampere's Law becomes $$B=\mu_0 In \tag{2}$$

where n is the number of turns per meter. For example, 20 mA applied through 200 windings in a 3 mm coil produces a magnetic field of about 17 gauss. This strength of magnetic field may be sufficient to drive ferrofluid slug 120 over a distance of about 3 mm in about 50 milliseconds.

Ferrofluid slug 120 may be any material which is magnetically permeable, yet in a fluid state. Examples of such materials include small ferromagnetic particles which are suspended in a liquid. The particles may be, for example, nanometer-sized particles of NiFe or permalloy, suspended in an oil such as. Such materials are manufactured by Ferrotec Corporation of Nashua, N.H. (see www.Ferrotec-.com/ferrofluid_technology_overview.htm). The only requirement for the ferrofluid is that the particles have sufficient affinity for the fluid such that they pull the fluid along with them, rather than being torn away from the fluid by the magnetostatic force. While the ferrofluid acts like a liquid in free space, in the presence of a magnetic field, the ferrofluid may become highly viscous, and even gel-like, and therefore somewhat more difficult to move within the confined cylindrical tube volume.

The size of ferrofluid slug 120 will depend, in part, on the operating parameters of ferrofluid magnetostatic actuator 100. A larger size slug will react with more force to an applied magnetic field; however, a larger size slug will also be slower to actuate. In contrast, a smaller ferrofluid slug will respond more quickly; however, a smaller slug will deliver less force. A ferrofluid slug of length 3 mm in a cylindrical tube of 0.5 mm diameter, for example, may be suitable for many applications.

Figure 4:
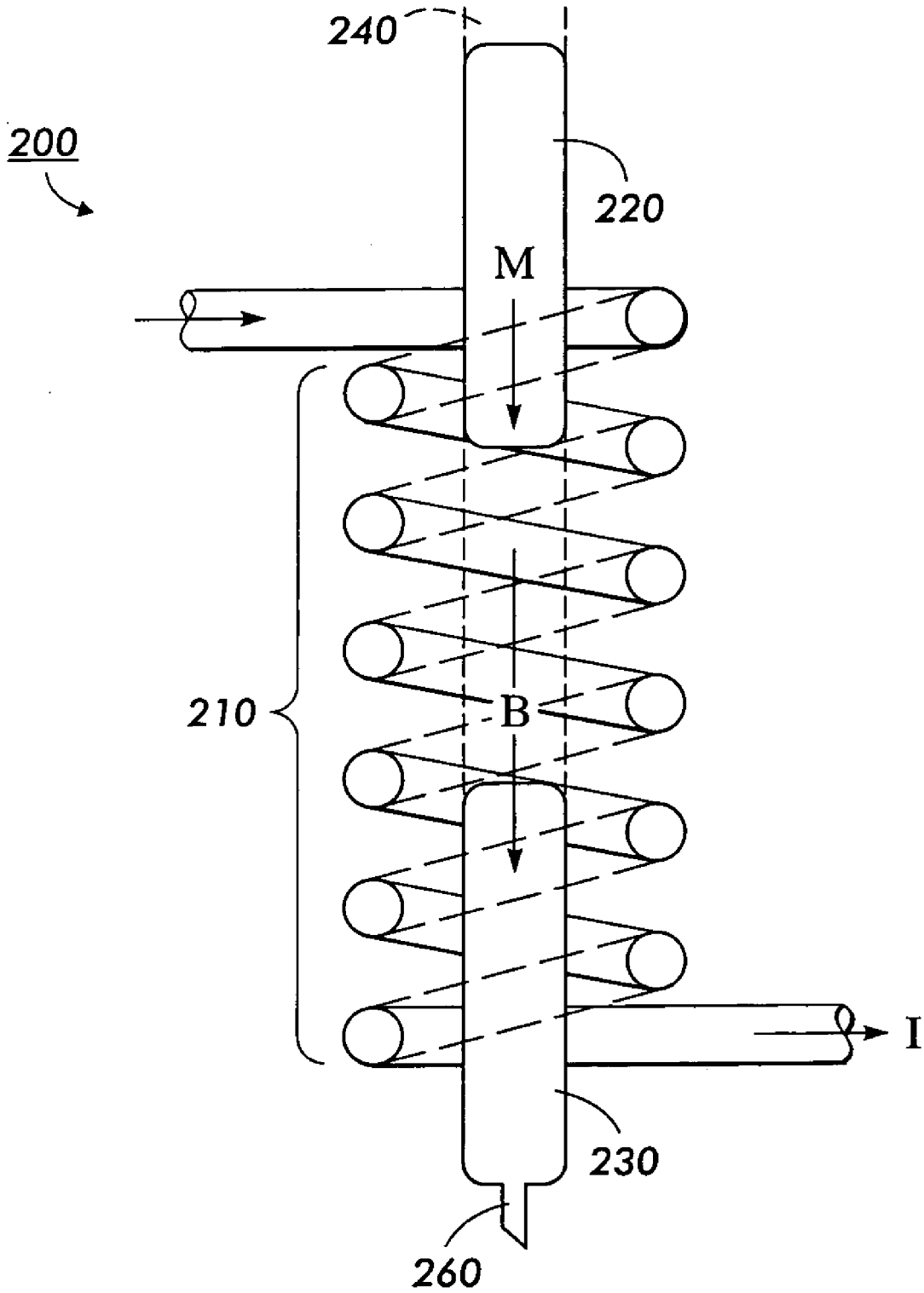
FIG. 4 illustrates an exemplary droplet dispenser using a magnetostatic actuator and ferrofluid slug.

Ferrofluid magnetostatic actuator 100 may be adapted to dispense droplets of fluid. FIG. 4 illustrates an exemplary droplet dispenser 200 using a ferrofluid magnetostatic actuator. The droplet dispenser 200 includes a coil 210, a cylindrical tube 240, a ferrofluid slug 220, and a working fluid 230. Ferrofluid slug 220 and working fluid 230 are contained in cylindrical tube 240. An air bubble 225 may separate ferrofluid slug 220 from working fluid 230. Cylindrical tube 240 may end in an orifice 260, for example, substantially smaller in diameter than cylindrical tube 240.

Droplet dispenser 200 may be operated by applying a current I to coil 210. As with ferrofluid magnetostatic actuator 100, coil 210 produces a magnetic field B along an axis defined by coil 210, as shown in FIG. 4. Magnetic field B interacts with ferromagnetic slug 220 to produce, for example, an attractive force between slug 220 and coil 210. Ferrofluid slug 220 may thus be drawn to the interior of coil 210 by the attractive force.

Figure 5:
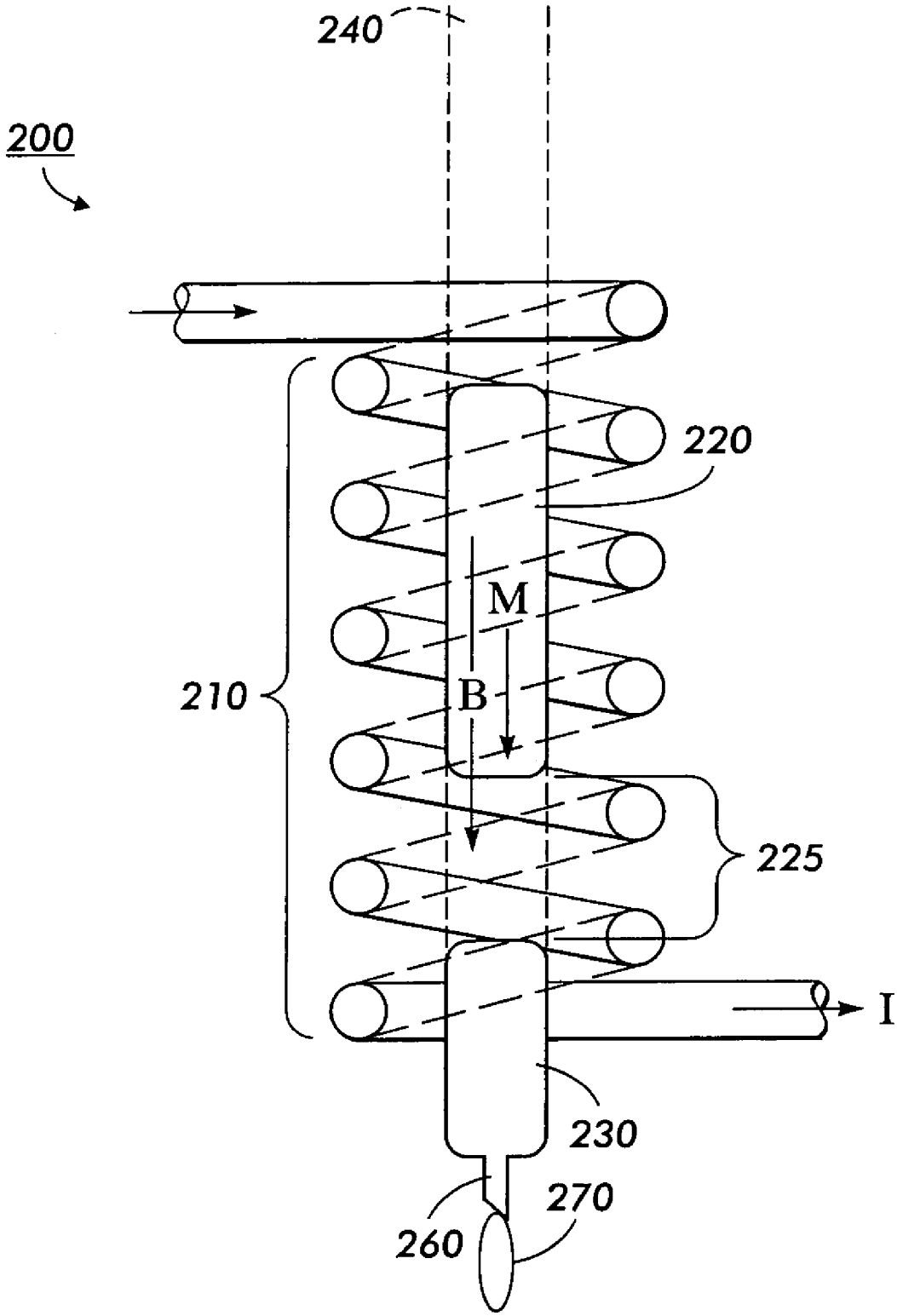
FIG. 5 illustrates the droplet dispenser of FIG. 4 dispensing a droplet.

FIG. 5 illustrates an operation of droplet dispenser 200 dispensing a droplet. As shown in FIG. 5, as ferrofluid slug 220 is drawn into coil 210, ferrofluid slug 220 pushes against bubble 225 and working fluid 230. The pressure of ferrofluid slug 220 against working fluid 230 causes some amount of working fluid 230 to be ejected from orifice 260, for example, in the form of a droplet 270. The impact of ferrofluid slug 220 against working fluid 230 delivers kinetic energy to emerging droplet 270, such that droplet 270 is forcibly ejected from orifice 260 with sufficient energy to overcome the surface tension of working fluid 230, which tends to adhere the forming droplet to the reservoir of fluid within cylindrical tube 240.

As mentioned above, air bubble 225 may be used to separate ferrofluid slug 220 from working fluid 230. Air bubble 225 may therefore physically separate the two fluids to prevent them from mixing. This may be advantageous in applications in which contamination of a sample is of particular concern, such as biotechnology applications. An air bubble of length of about 1 mm, for example, may be sufficient to adequately isolate ferrofluid slug 220 from working fluid 230. However, because air is compressible, the presence of air bubble 225 may cause droplet dispenser 200 to lose force and speed.

In other implementations, rather than air bubble 225, immiscible fluids may be used. For example, an oil-based ferrofluid slug with a water-based working fluid may be used. If the fluids are sufficiently immiscible, the fluids will not mix, or even form regions containing the other material, especially if they are confined by the cylindrical tube to a small enough volume. The 0.5 mm diameter cylindrical tube described previously, for example, may be a small enough volume to discourage mixing of an oil-based ferrofluid and a water-based working fluid.

The choice of a diameter for orifice 260 is important in determining the properties of ejected droplet 270. If the diameter is chosen too large, then droplet 260 will dribble out rather than being ejected. This reduces the precision and reliability with which the droplets of fluid can be produced. If the diameter of orifice 260 is chosen too small, viscous forces within orifice 260 can cause clogging and slow dispensing of droplets. An orifice diameter which is approximately one order of magnitude smaller than the cylindrical tube diameter may be suitable for many applications. Therefore, for a cylindrical tube diameter of 0.5 mm, the orifice diameter may be, for example, 50 microns. Using an orifice/cylindrical tube diameter ratio of much greater than 1 also assures that ferrofluid slug 220 needs only to move over a relatively small distance in order to displace a desired volume of working fluid 230.

Using droplet dispenser 200 configured as discussed above, droplets may be produced, for example, ejected with a speed of several meters per second, and with a repetition rate of 100–200 Hertz. The precise dimensions of the droplets produced may be measured by strobing the droplets in free flight, and using a calibrated eyepiece to measure the diameter of the droplets. It is estimated that droplet dispenser 200 shown in FIGS. 3 and 4, and having the dimensions discussed above, may be used to produce droplets having volumes in the 50–500 nanoliter range.

In order to dispense a droplet in this range, ferrofluid slug 220 may be urged by the magnetic field produced in coil 210 to travel a distance of about 0.3 microns. Therefore, over the total throw of about 3 mm of ferrofluid slug 220 within coil 210, thousands of droplets can be produced from the amount of working fluid 230. Once working fluid 230 has been exhausted, cylindrical tube 240 may be removed from coil 210 and discarded and replaced with a full cylindrical tube, or cylindrical tube 240 can be cleaned and reused, if desired.

Figure 6:
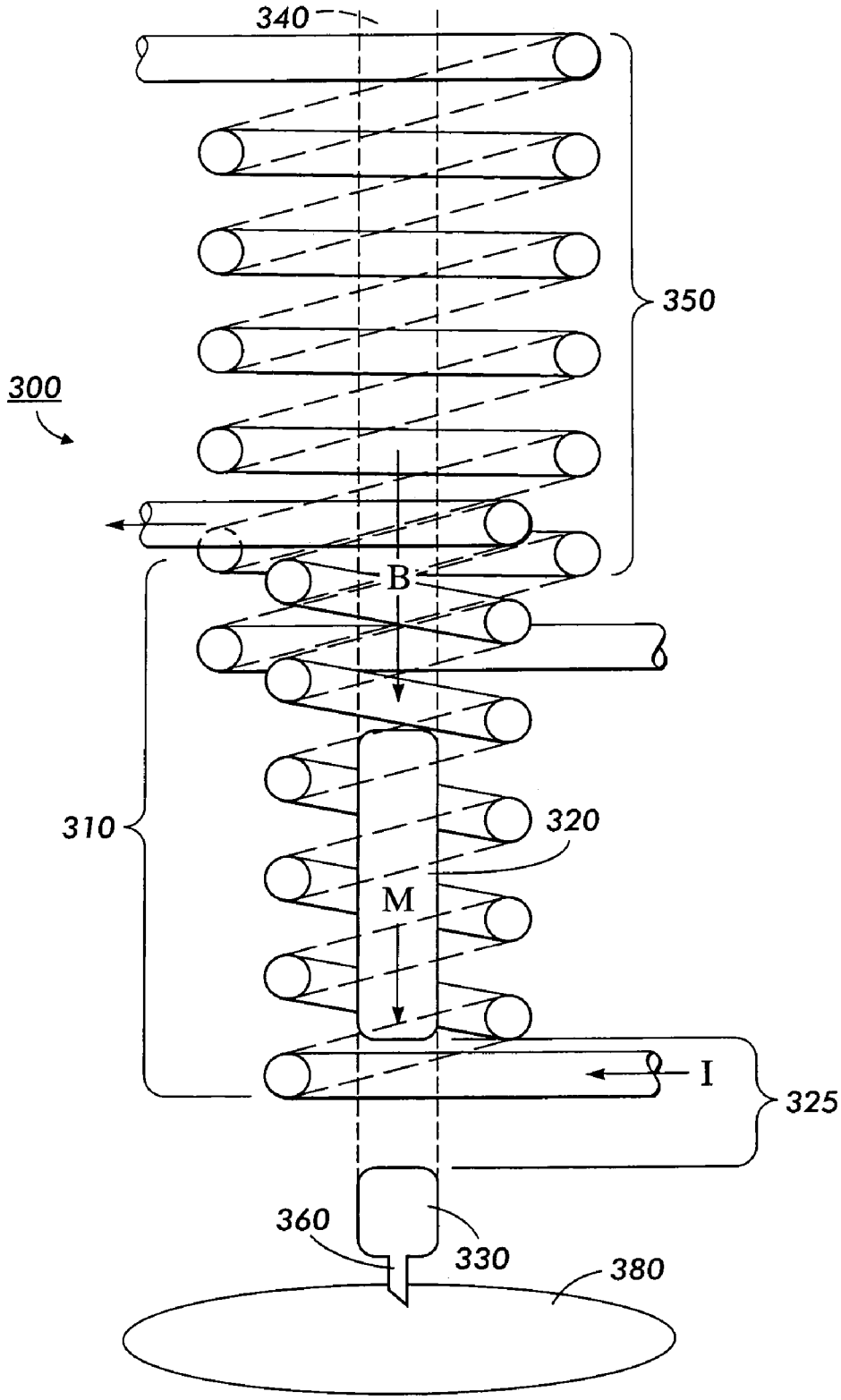
FIG. 6 illustrates an exemplary ferrofluid magnetostatic droplet dispenser using dual coils, with the tip immersed in a reservoir of fluid.

FIG. 6 illustrates an exemplary droplet dispenser 300 which can be refilled directly from a reservoir 380. Droplet dispenser 300 has two sets of coils 310 and 350. Droplet dispenser 300 also contains a ferrofluid slug 320 and a working fluid 330 contained in a cylindrical tube 340. As with droplet dispenser 200, droplet dispenser 300 is operated by applying a current to coil 310, which generates a magnetic field B along an axis defined by coil 310, and induces a magnetization M in ferrofluid slug 320. The interaction of magnetic field B with magnetization M of ferrofluid slug 320 results in an attractive force, for example, which tends to draw ferrofluid slug 320 into the interior of coil 310.

However, when droplet dispenser 300 has reached the end of its throw, for example, when ferrofluid slug 320 has been drawn entirely within coil 310, second coil 350 can then be energized, and the current in coil 310 can be discontinued. Because the end of ferrofluid slug 320 is still in proximity to coil 350, ferrofluid slug 320 will interact with the fringing fields produced by coil 350, and magnetization M will be induced in ferrofluid slug 320 in response to the fringing fields from coil 350.

Figure 7:
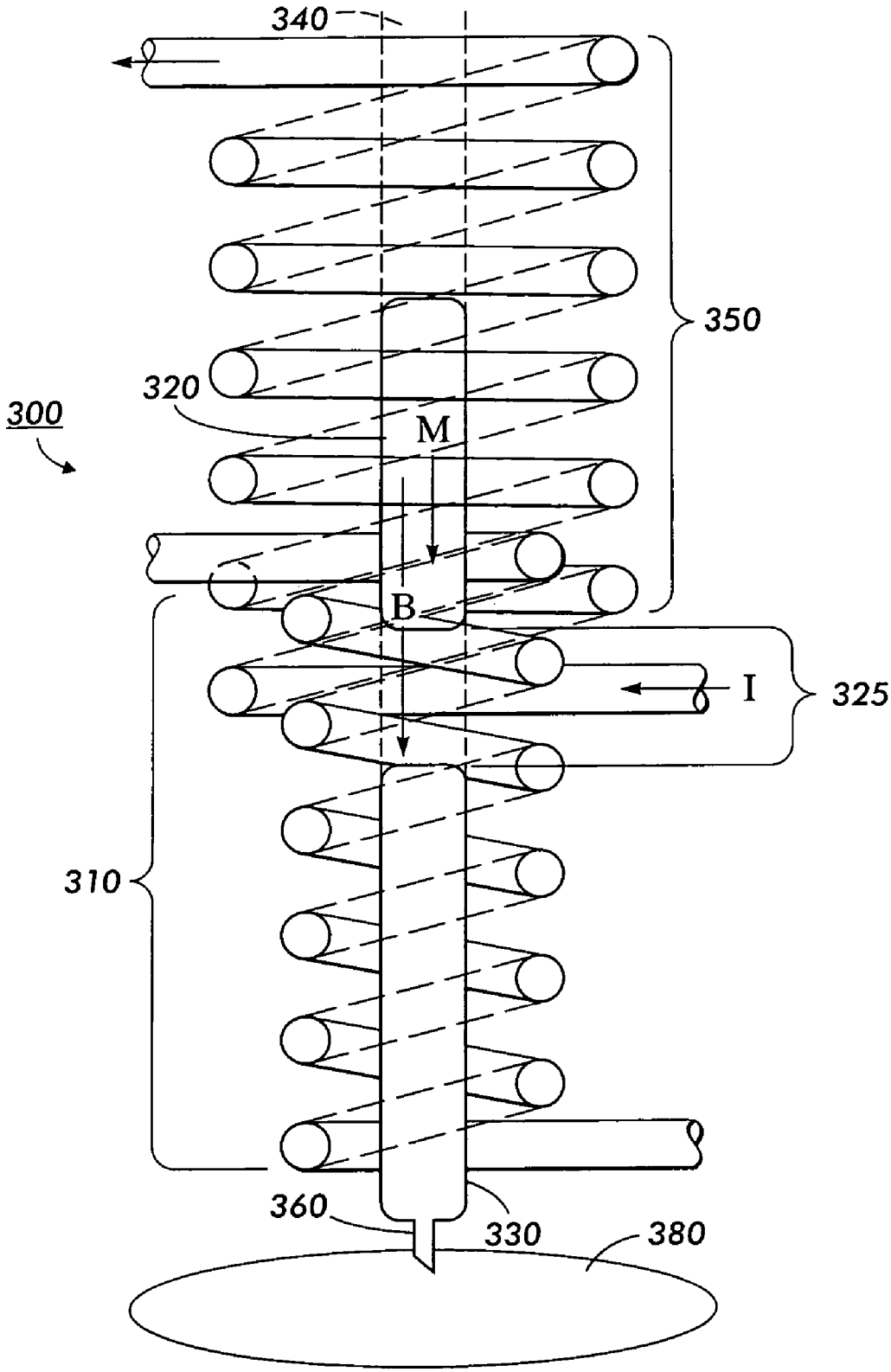
FIG. 7 illustrates the ferrofluid magnetostatic droplet dispenser of FIG. 6 aspirating the fluid.

As shown in FIG. 7, the interaction of magnetization M with the fringing fields of coil 350, for example, results in an attractive force between ferrofluid slug 320 and coil 350, and ferrofluid slug 320 is thus drawn back toward coil 350. Accordingly, using the apparatus shown in FIG. 6, ferrofluid slug 320 may be retracted from a fully extended position shown in FIG. 6, back into a retracted position shown in FIG. 7.

The reverse movement of ferrofluid slug 320 in FIG. 7 causes a vacuum to exist on the top side of working fluid 330. If orifice 360 is submerged in reservoir 380 of working fluid, fluid from reservoir 380 may be drawn into cylindrical tube 340, because of the vacuum produced by ferrofluid slug 320. Therefore, by activating first coil 310, followed by activating coil 350, droplet dispenser 300 can first dispense the working fluid in droplet form, and then aspirate additional fluid from reservoir 380.

One aspect of droplet dispensers is the dead volume of the dispenser, which is defined as the difference between the minimum aspiration volume and the maximum dispense volume. In various prior art devices, the dead volume could be substantial because of the distance between the ejection orifice and the driving force (the miniature solenoid valve). A larger distance increases the probability that curvatures or depressions exist in the dispensers, where eddy currents can form which reduce the minimum aspiration volume, thereby increasing the dead volume. In droplet dispenser 300 shown in FIGS. 6 and 7, the dead volume is almost zero, for example, because the driving forces (coils 310 and 350) are located very near the ejection orifice 360.

While droplet dispenser 300 shown in FIG. 6 the two sets of coils 350 and 310 that overlap, such a configuration is not required. Instead, the coils may abut or even be separated by some nominal distance, as long as ferrofluid slug 320, when located inside one of the coils will still interact sufficiently with the fringing fields from the other coil to be drawn into the other coil interior. This situation can be virtually guaranteed by making the length of ferrofluid slug 320 exceed the length of the coils by some margin which is similar to the distance separating the coils.

Figure 8:
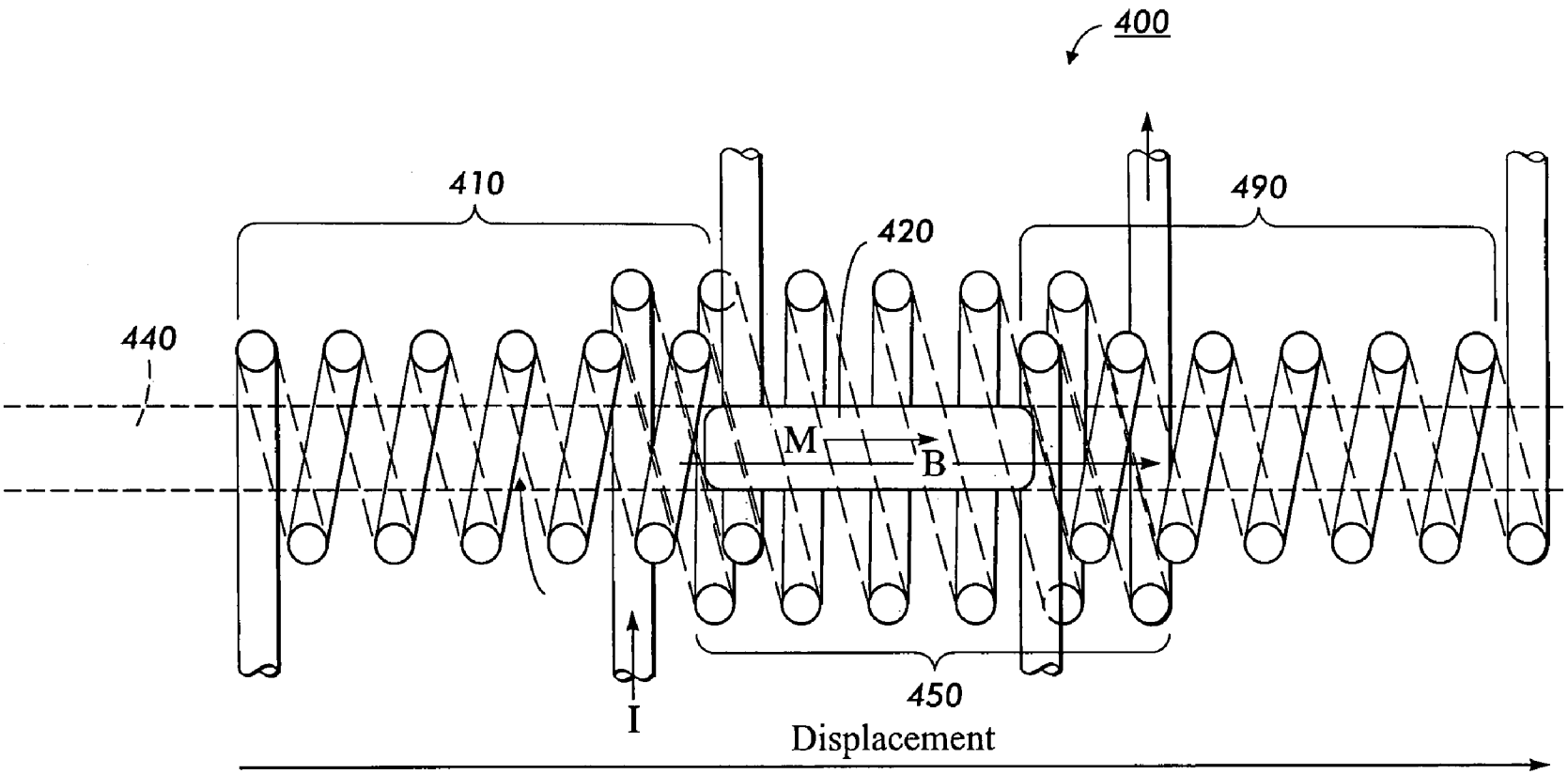
FIG. 8 illustrates an exemplary ferrofluid magnetostatic actuator, using a plurality of driving coils.
Figure 9:
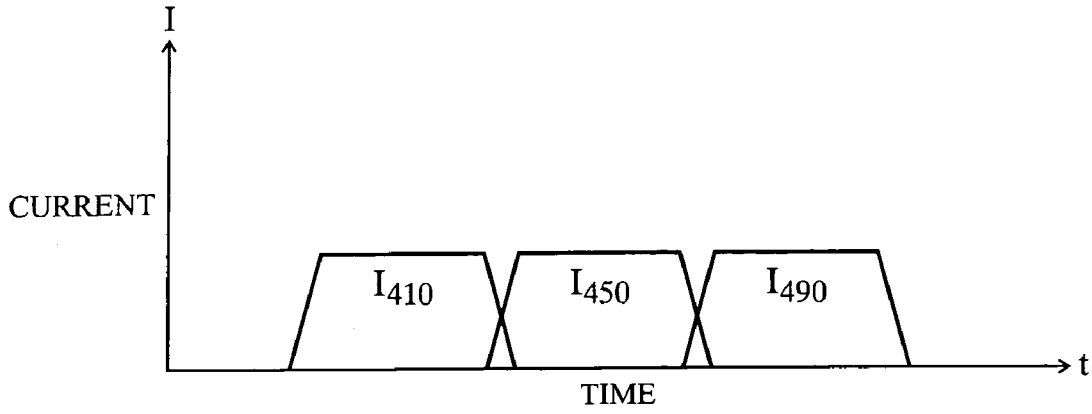
FIG. 9 is a schematic plot of exemplary current profiles that can be used, for example, with the ferrofluid magnetostatic actuator of FIG. 8, to extend the operating range of the actuator.

FIG. 8 shows an exemplary ferrofluid actuator 400 having a plurality of coils 410, 450 and 490. The plurality of coils 410, 450 and 490 may be used to increase the throw of ferrofluid slug 420 inside cylindrical tube 440. In particular, ferrofluid slug 420 may be drawn from a first coil 410 to a second coil 450, and then to a third coil 490, by the appropriate selection and timing of current waveforms applied to coils 410, 450 and 490. For example, as shown in FIG. 9, coil 410 may be energized first by applying a current $I_{410}$ to coil 410. This current generates a magnetic field along an axis defined by coil 410. The magnetic field interacts with ferrofluid slug 420, for example, to draw ferrofluid slug 420 into the interior region of coil 410. The current $I_{410}$ is then discontinued, and another current waveform $I_{450}$ is applied to the next coil 450. The current $I_{450}$ generates a magnetic field along an axis defined by coil 450, which then interacts with ferrofluid slug 420. As a result, ferrofluid slug 420 is drawn into the interior of coil 450, at which point the current $I_{450}$ to coil 450 is discontinued. Then another current $I_{490}$ is applied to the third coil 490. This current $I_{490}$ generates a magnetic field along an axis defined by coil 490. The magnetic field interacts with the ferrofluid slug 420 to draw ferrofluid slug 420 into the interior of coil 490.

Figure 10:
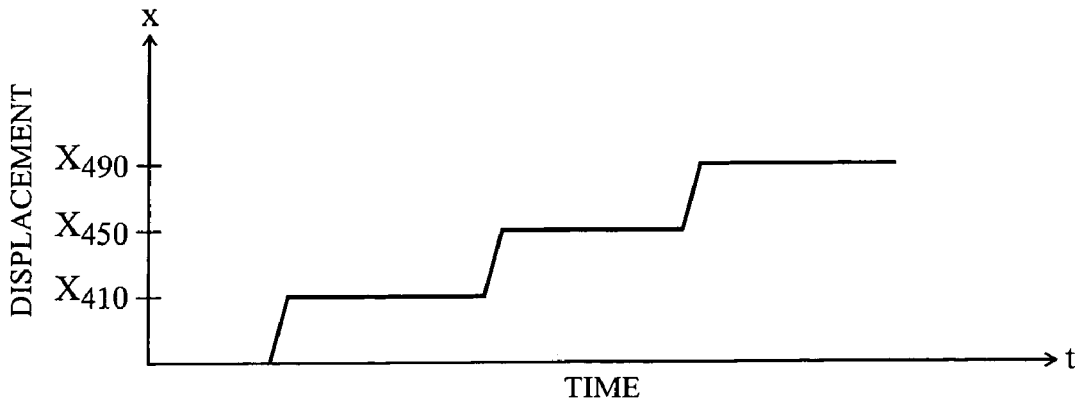
FIG. 10 is a schematic plot of displacement of the ferrofluid slug which results from the application of the current profiles of FIG. 9.

Therefore, by successively passing ferrofluid slug 420 from one coil to the next, the total throw of the device is increased by a factor of about three times. This behavior is illustrated, for example, in FIG. 10, which shows the displacement of ferrofluid slug 420 as a function of time during the application of the various current waveforms shown in FIG. 9. During the application of current $I_{410}$, ferrofluid slug 420 moves to a position $x_{410}$. During application of current $I_{450}$, ferrofluid slug 420 moves to position $x_{450}$. During application of current $I_{490}$, ferrofluid slug 420 moves to position $x_{490}$.

Furthermore, by using multiple coils, the ferrofluid slug may be caused to travel in the opposite direction, for example, used to aspirate the fluid volume in the dual coil example of FIGS. 6 and 7. For example, coil 410 can be used to displace ferrofluid slug 420 in a direction to eject a droplet. However, after the ferrofluid slug 420 has been displaced toward the orifice to eject the droplet, ferrofluid slug 420 may be caused to rapidly switch directions by application of a current pulse to coil 450. If the reversal occurs before the droplet is free of the orifice, the sudden reversal will cause the tail of the droplet to be stretched. The tail of the droplet results from surface tension which tends to adhere the droplet to the fluid reservoir in the cylindrical tube. The stretching of the tail occurs because the inertia of the droplet causes the droplet to continue to move in the direction in which the droplet was pushed by the ferrofluid slug 420. By reversing the movement of the ferrofluid slug 420 as the droplet is leaving the orifice, the distance between the droplet and the fluid reservoir may be increased. The stretching of the tail may cause the droplet to be snapped from the fluid reservoir inside the cylindrical tube, thus creating a droplet of more precise and repeatable dimensions.

Figure 11:
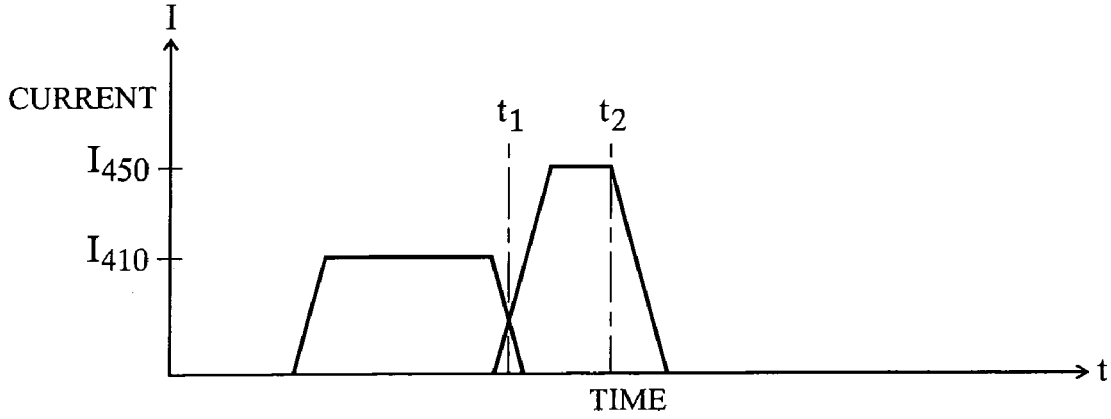
FIG. 11 is a schematic plot of exemplary current profiles that can be used, for example, with the ferrofluid magnetostatic actuator of FIG. 8, to create a whiplash effect.
Figure 12:
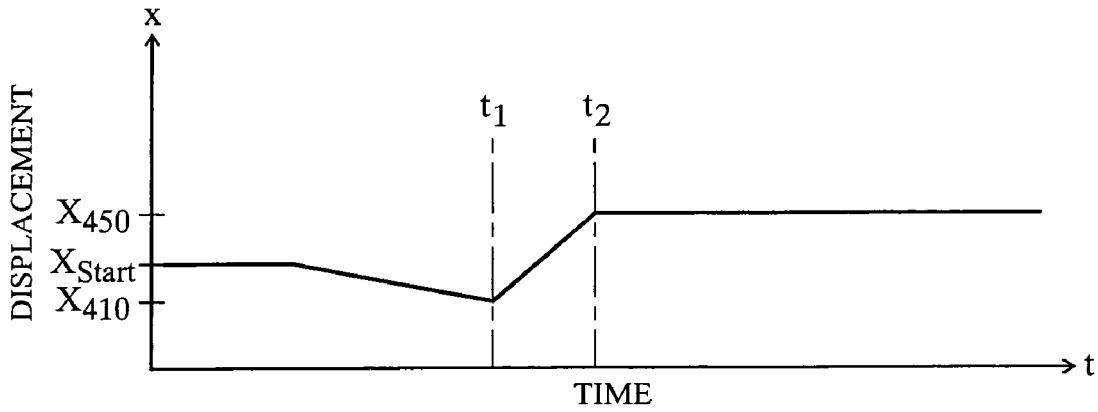
FIG. 12 is a schematic plot of the displacement of the ferrofluid slug which results from application of the current profiles of FIG. 11.

In this scenario, ferrofluid slug 420 may start at an intermediate position $x_{start}$, between coils 410 and 450. Then coil 410 may be energized by application of current $I_{410}$, as illustrated in FIG. 11. This may cause ferrofluid slug 420 to be drawn to the interior of coil 410, to position $x_{410}$, as indicated in FIG. 12. At a time $t=t_1$, however, the current $I_{410}$ is discontinued, and another current $I_{450}$ may be applied to coil 450. This causes the ferrofluid slug 420 to reverse direction, and travel to position $x_{450}$. When ferrofluid slug 420 reaches position $x_{450}$ at time $t_2$, the current through coil 450 is discontinued. The trajectory of ferrofluid slug 420 is of a "whiplash" type, so that the tail of the droplet formed is stretched in the period $t_1$ to $t_2$, and snaps at point $t_2$.

Figure 13:
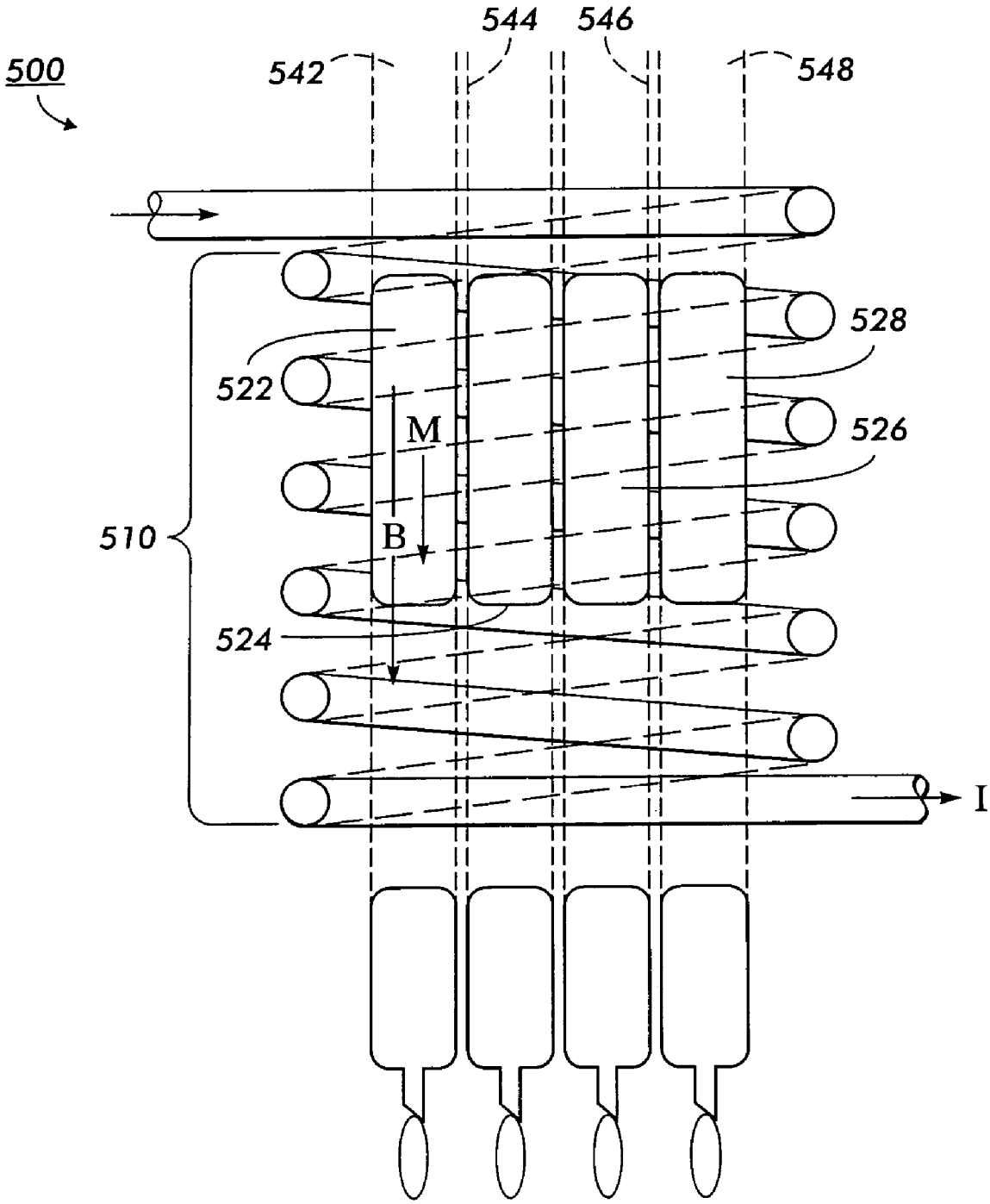
FIG. 13 is an exemplary embodiment of a ferrofluid magnetostatic actuator wherein a single coil drives multiple ferrofluid slugs.

FIG. 13 illustrates another exemplary ferrofluid droplet dispenser 500, wherein a plurality of cylindrical tubes 542–548 is disposed within a single coil 510. Each cylindrical tube 542–548 encloses a ferrofluid slug 522–528 and working fluid 532–538, respectively. By energizing coil 510, a parallel dispensation of droplets may be generated from cylindrical tubes 542–548. Therefore, the droplet production rate of ferrofluid droplet dispenser 500 is four times that of a single cylindrical tube operating, for example, in ferrofluid droplet dispenser 100. In addition, cylindrical tubes which have been emptied of fluid can be easily replaced by removing the empty cylindrical tube from coil 510, and replacing the cylindrical tube with a full cylindrical tube.

Figure 14:
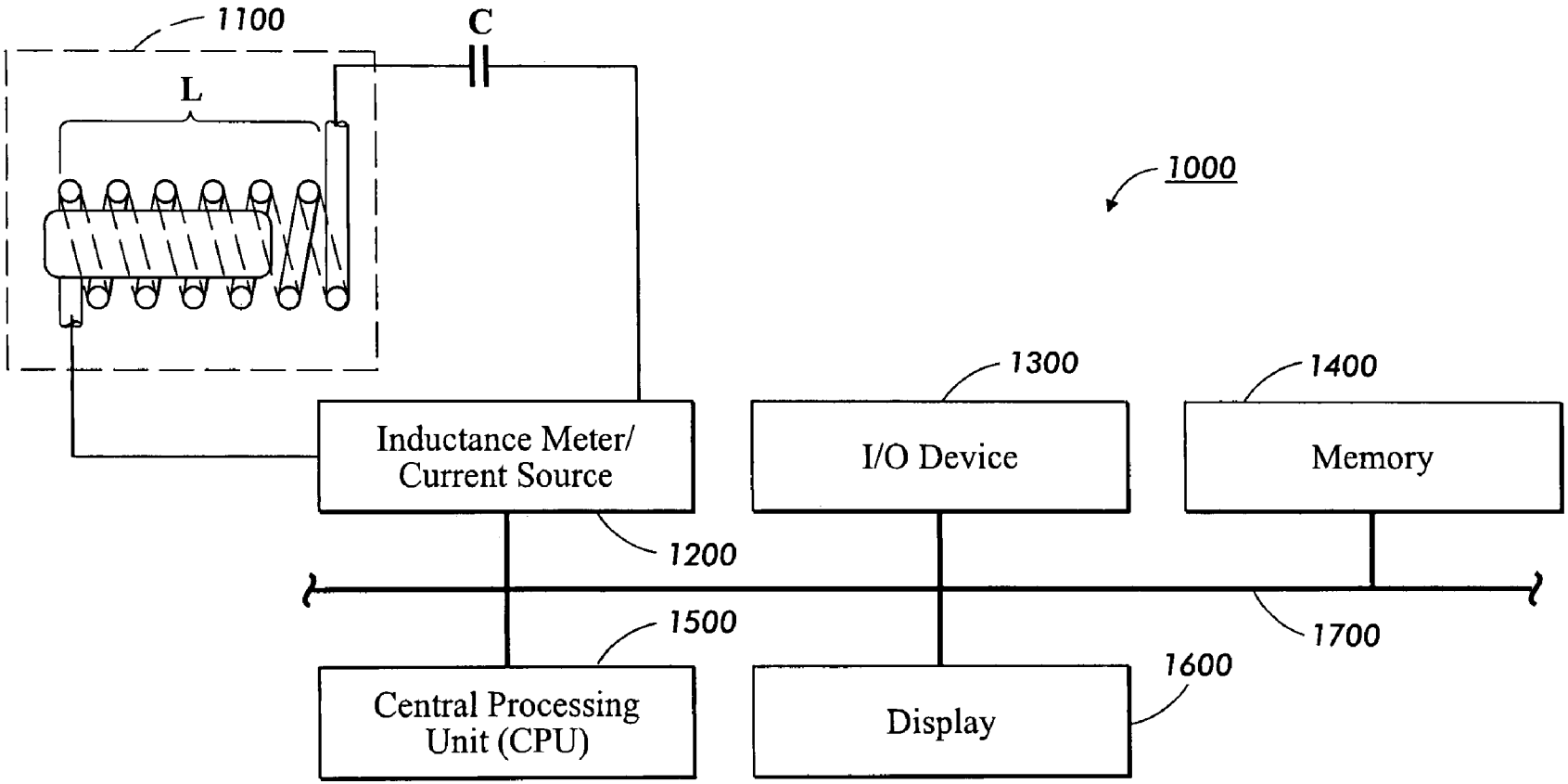
FIG. 14 is an exemplary diagram of a system for measuring the inductance of the ferrofluid magnetostatic actuator of FIG. 2.

Relatively complex current waveforms can be applied to the various coils, for example, by using a computer to generate the waveforms and to control their timing and application. An exemplary system 1000 is shown in FIG. 14. The system 1000 is shown as a block diagram, including a ferrofluid magnetostatic actuator 1100, a current source/inductance meter 1200, an input/output device 1300, a memory 1400, a CPU 1500, and a display 1600. Current source/inductance meter 1200 is a device which generates a current waveform having the properties requested by CPU 1500, such as magnitude and duration, or if an AC signal is requested, the frequency. The aforementioned components 1200–1600 may communicate via a bus 1700, or they may be integrated as an application specific integrated circuit (ASIC), for example.

For clarity of depiction, ferrofluid magnetostatic actuator 1100 is shown as including only a single coil 1110 and one ferrofluid slug 1120. However, other implementations are possible.

A user may designate the waveform parameters such as pulse duration and magnitude, by inputting such information to CPU 1500 via input/output device 1300, which may be, for example, a keyboard or a mouse. Alternatively, the user may designate the size and number of droplets desired, and CPU 1500 may calculate an appropriate waveform to produce the desired droplets. For example, CPU 1500 may generate the waveforms shown in FIG. 11, and output the waveforms to current source/inductance meter 1200, which may be multiplexed to a plurality of coils (not shown) in ferrofluid magnetostatic actuator 1100.

In addition to providing a complex current waveform, system 1000 may also provide information as to the location of ferrofluid slug 1120 inside coil 1110. The presence of magnetizable ferrofluid slug 1120 will change the inductance of the surrounding coil 1110, based on the proportion of ferrofluid slug 1120 which is located inside coil 1110. Therefore, the position of ferrofluid slug 1120 may be monitored by measuring the inductance in the corresponding coil 1110. Any of a number of techniques may be used to measure the inductance of the coil, an example of which is described below.

To measure the inductance of coil 1110, a capacitance C may be placed in series with coil 1110 of ferrofluid magnetostatic actuator 1100, as shown in FIG. 14, to create a resonant circuit. CPU 1500 may then select a range of input frequencies for current source/inductance meter 1200, which generates the waveforms and inputs them into coil 1110 of ferrofluid magnetostatic actuator 1100. CPU 1500 then monitors the resonant frequency measured by current source/inductance meter 1200, and converts the resonant frequency based on the quantity LC into an inductance L, given the known value of the capacitance C placed in the circuit. CPU 1500 may then convert this inductance into a position for ferrofluid slug 1120 inside coil 1110. CPU 1500 may output this value to display 1600, for viewing by an operator, or store the value in memory 1400.

System 1000 may be used to dispense a known quantity of droplets, or tailor the current waveforms applied to the coil(s), to achieve a certain droplet size (for example, by creating the whiplash profile described above), or to monitor the displacement of ferrofluid slug 1120, and alert an operator if one of the cylindrical tubes containing the ferrofluid slug appears to be empty, based on the displacement of the ferrofluid slug.

While details of this invention have been described above, various alternatives, modifications, variations, improvements, and/or substantial equivalents, whether known or that may be presently unforeseen, may become apparent upon reviewing the foregoing disclosure. For example, in addition to the droplet dispenser described above, the ferrofluid magnetostatic actuator may also be used to control a valve or switch. Accordingly, the exemplary details of the invention, as set forth above, are intended to be illustrative, not limiting.

What is claimed is:

1. A magnetostatic actuator, comprising:

at least one tube;

at least one ferrofluid slug contained in the at least one tube;

at least one coil around the at least one tube that, when energized, generates a magnetic field along an axis defined by the at least one coil, wherein the magnetic field interacts with the ferrofluid slug to move the at least one ferrofluid slug;

a working fluid contained in the at least one tube, wherein movement of the at least one ferrofluid slug causes a droplet of the working fluid to be formed at an orifice of the at least one tube; and an air bubble contained in the at least one tube, between the working fluid and the at least one ferrofluid slug.

2. The magnetostatic actuator of claim 1, wherein the at least one coil comprises a first coil and a second coil disposed adjacent to one another.

3. The magnetostatis actuator of claim 2, wherein a fringing field of the first coil at least partially overlaps a fringing field of the second coil.

4. The magnetostatic actuator of claim 1, wherein a diameter of the at least one tube is less than about 1 mm, and a length of the at least one ferrofluid slug is less that about 3 mm.

5. The magnetostatic actuator of claim 1, wherein the at least one coil is energized by a series of current pulses which give the at least one ferrofluid slug a whiplash trajectory.

6. The magnetostatic actuator of claim 1, further comprising: an inductance meter that measures an inductance of the at least one coil.

7. A magnetostatic actuator, comprising:

at least one tube;

at least one ferrofluid slug contained in the at least one tube;

at least one coil around the at least one tube that, when energized, generates a magnetic field along an axis defined by the at least one coil, wherein the magnetic field interacts with the ferrofluid slug to move the at least one ferrofluid slug; and a piston contained in the at least one tube adjacent to the at least one ferrofluid slug, wherein movement of the at least one ferrofluid slug causes movement of the piston.

8. The magnetostatic actuator of claim 7, the piston being a movable element attached to an electric switch or valve.

9. A magnetostatic actuator, comprising:

at least one tube;

at least one ferrofluid slug contained in the at least one tube; and at least one coil around the at least one tube that, when energized, generates a magnetic field along an axis defined by the at least one coil, wherein the magnetic field interacts with the ferrofluid slug to move the at least one ferrofluid slug;

wherein the at least one coil comprises a first coil and a second coil partially overlapping.

10. A magnetostatic actuator, comprising:

at least one tube;

at least one ferrofluid slug contained in the at least one tube; and at least one coil around the at least one tube that, when energized, generates a magnetic field along an axis defined by the at least one coil, wherein the magnetic field interacts with the ferrofluid slug to move the at least one ferrofluid slug;

wherein the at least one tube comprises a plurality of tubes, and the at least one coil is disposed around the plurality of tubes.

11. A magnetostatic actuator, comprising:

at least one tube;

at least one ferrofluid slug contained in the at least one tube;

at least one coil around the at least one tube that, when energized, generates a magnetic field along an axis defined by the at least one coil, wherein the magnetic field interacts with the ferrofluid slug to move the at least one ferrofluid slug, wherein the at least one coil is energized by a series of current pulses which give the at least one ferrofluid slug a whiplash trajectory; and a central processing unit that obtains a displacement of the at least one ferrofluid slug, based on the measured inductance of the at least one coil.

12. A method for actuating a ferrofluid slug, comprising:

delivering a current to at least one coil around at least one tube containing the ferrofluid slug;

generating a magnetic field via the current flowing through the at least one coil;

inducing a magnetic moment in the ferrofluid slug; and displacing the ferrofluid slug in a first direction by the interaction of the magnetic moment of the ferrofluid slug with the magnetic field, the at least one tube containing:

a working fluid contained in the at least one tube, wherein movement of the at least one ferrofluid slug causes a droplet of the working fluid to be formed at an orifice of the at least one tube; and an air bubble contained in the at least one tube, between the working fluid and the at least one ferrofluid slug.

13. The method of claim 12, further comprising:

delivering another current to another coil around the at least one tube;

generating another magnetic field from the current flowing through the other coil;

inducing another magnetic moment in the ferrofluid slug with the other magnetic field; and displacing the ferrofluid slug in a second direction by the interaction of the other magnetic moment with the other magnetic field.

14. The method of claim 12, further comprising:

delivering another current to another coil around the at least one tube;

generating another magnetic field from the current flowing through the other coil;

inducing another magnetic moment in the ferrofluid slug with the other magnetic field; and displacing the ferrofluid slug in the first direction by an additional amount, by the interaction of the other magnetic moment with the other magnetic field.

15. The method of claim 12, further comprising:

applying pressure to a volume of working fluid contained in the at least one tube by the displaced ferrofluid slug;

ejecting a droplet of the working fluid from an orifice of the at least one tube.

16. The method of claim 12, further comprising:

ejecting a droplet from an orifice of the at least one tube by the displacement of the ferrofluid slug.

17. A method for actuating a ferrofluid slug, comprising:

delivering a current to at least one coil around at least one tube containing the ferrofluid slug;

generating a magnetic field via the current flowing through the at least one coil;

inducing a magnetic moment in the ferrofluid slug;

displacing the ferrofluid slug in a first direction by the interaction of the magnetic moment of the ferrofluid slug with the magnetic field;

applying pressure to a piston contained in the at least one tube by the displaced ferrofluid slug; and displacing the piston within the at least one tube by the pressure exerted by the ferrofluid slug.

18. The method of claim 17, the piston being a movable element attached to an electric switch or valve.

19. A method for actuating a ferrofluid slug, comprising:

delivering a current to at least one coil around at least one tube containing the ferrofluid slug;

generating a magnetic field via the current flowing through the at least one coil;

inducing a magnetic moment in the ferrofluid slug;

displacing the ferrofluid slug in a first direction by the interaction of the magnetic moment of the ferrofluid slug with the magnetic field; and measuring the displacement of the ferrofluid slug by measuring the inductance of the at least one coil.

20. An apparatus for actuating a ferrofluid slug, comprising:

means for delivering a current to at least one coil around at least one tube containing the ferrofluid slug;

means for generating a magnetic field from the current flowing through the at least one coil;

means for inducing a magnetic moment in the ferrofluid slug with the magnetic field;

means for displacing the ferrofluid slug in a first direction by the interaction of the magnetic moment of the ferrofluid slug with the magnetic field;

a working fluid contained in the at least one tube, wherein movement of the at least one ferrofluid slug causes a droplet of the working fluid to be formed at an orifice of the at least one tube; and an air bubble contained in the at least one tube, between the working fluid and the at least one ferrofluid slug.

* * * * *

UNITED STATES PATENT AND TRADEMARK OFFICE

CERTIFICATE OF CORRECTION

PATENT NO. : 7,204,581 B2
APPLICATION NO. : 10/958428
DATED : April 17, 2007
INVENTOR(S) : Eric Peeters It is certified that error appears in the above-identified patent and that said Letters Patent is hereby corrected as shown below:

Title page Item

Please delete the following:

(73) Assignee: Palo Alto Research Center, Incorporated, Palo Alto, CA (US)

And Replace with the following:

(73) Assignee: Palo Alto Research Center Incorporated, Palo Alto, CA (US)

Signed and Sealed this

Fourteenth Day of October, 2008

JON W. DUDAS
*Director of the United States Patent and Trademark Office*